US011976542B1

(12) United States Patent
Duhn et al.

(10) Patent No.: US 11,976,542 B1
(45) Date of Patent: May 7, 2024

(54) FRAC DISTRIBUTION TOWER

(71) Applicants: Rex E. Duhn, Spring, TX (US); Robert K. Meek, Bakersfield, CA (US)

(72) Inventors: Rex E. Duhn, Spring, TX (US); Robert K. Meek, Bakersfield, CA (US)

(73) Assignee: Rex E. Duhn, Spring, TX (US)

( * ) Notice: Subject to any disclaimer, the term of this patent is extended or adjusted under 35 U.S.C. 154(b) by 0 days.

(21) Appl. No.: 18/107,367

(22) Filed: Feb. 8, 2023

(51) Int. Cl.
*E21B 43/26* (2006.01)
*E21B 21/10* (2006.01)

(52) U.S. Cl.
CPC ..... *E21B 43/2607* (2020.05); *E21B 21/106* (2013.01); *E21B 43/26* (2013.01)

(58) Field of Classification Search
CPC ..... E21B 43/2607; E21B 21/106; E21B 43/26
See application file for complete search history.

(56) References Cited

U.S. PATENT DOCUMENTS

| | | | |
|---|---|---|---|
| 8,376,046 | B2 | 2/2013 | Broussard |
| 8,474,521 | B2 | 7/2013 | Kajaria et al. |
| 8,813,836 | B2 | 8/2014 | Kajaria et al. |
| 8,839,867 | B2 | 9/2014 | Conrad |
| 9,068,450 | B2 | 6/2015 | Guidry |
| 9,255,469 | B2 | 2/2016 | Conrad |
| 9,518,430 | B2 | 12/2016 | Conrad |
| 9,903,190 | B2 | 2/2018 | Conrad |
| 9,915,132 | B2 | 3/2018 | Conrad |
| 9,932,800 | B2 | 4/2018 | Guidry |
| 10,094,195 | B2 | 10/2018 | Guidry |
| 10,309,564 | B1 | 6/2019 | McGuire et al. |
| 10,323,475 | B2 | 6/2019 | Christopherson et al. |
| 10,385,643 | B2 | 8/2019 | Guidry |
| 10,385,644 | B2 | 8/2019 | Guidry et al. |

(Continued)

FOREIGN PATENT DOCUMENTS

AU 2021203111 6/2021

OTHER PUBLICATIONS

Cameron (A Schlumberger Company) Brochure entitled: Frac Manifold Systems—Increase operational efficiencies of simultaneous completion operations (16 pages).

(Continued)

*Primary Examiner* — James G Sayre
(74) *Attorney, Agent, or Firm* — Conley Rose, P.C.

(57) ABSTRACT

One or more frac distribution towers are positioned on a well pad and receive high pressure frac fluid from a remote source including one or more pumps. The tower has an inlet and multiple outlets, each outlet having a valve to selectively supply frac fluid to one or more wells. The inlet and the outlets each have a centerline, and the outlets may all be located on the same side of a plane defined by the centerline of the frac distribution tower and the centerline of the inlet. Outlet valves may be oriented horizontally, vertically, or angularly between horizontal and vertical. The inlet and the outlets may have the same size and pressure rating, or the outlets may have a smaller size than the inlet, such that multiple wells may be fracked simultaneously. More than one frac distribution tower may be positioned on a well pad and connected to each other using a tee fitting so as to provide high pressure frac fluid to each tower, and from each tower to one or more frac trees on multiple wells.

22 Claims, 12 Drawing Sheets

(56) References Cited

U.S. PATENT DOCUMENTS

| | | | | |
|---|---|---|---|---|
| 10,385,645 | B2 | 8/2019 | Guidry | |
| 10,385,662 | B2 | 8/2019 | Conrad | |
| 10,683,708 | B2 | 6/2020 | Hill et al. | |
| 10,774,965 | B1 | 9/2020 | Travis | |
| 10,871,059 | B2 | 12/2020 | Keihany et al. | |
| 11,162,320 | B2 | 11/2021 | Christopherson et al. | |
| 11,585,200 | B1 * | 2/2023 | Startz | E21B 43/2607 |
| 2014/0352968 | A1 * | 12/2014 | Pitcher | E21B 43/2607 166/308.1 |
| 2016/0115773 | A1 * | 4/2016 | Conrad | E21B 43/2607 166/308.1 |
| 2016/0376864 | A1 * | 12/2016 | Roesner | E21B 33/068 166/308.1 |
| 2017/0138144 | A1 * | 5/2017 | Christopherson | E21B 43/2607 |
| 2017/0198548 | A1 | 7/2017 | Dickinson | |
| 2017/0314379 | A1 * | 11/2017 | Guidry | E21B 43/26 |
| 2018/0058171 | A1 * | 3/2018 | Roesner | E21B 33/068 |
| 2018/0187537 | A1 | 7/2018 | Hill et al. | |
| 2020/0325752 | A1 * | 10/2020 | Clark | E21B 43/26 |
| 2021/0079775 | A1 | 3/2021 | Keihany et al. | |
| 2021/0148500 | A1 * | 5/2021 | Farquharson | F16L 39/02 |
| 2021/0199217 | A1 * | 7/2021 | Bucciarelli | E21B 43/26 |
| 2021/0310346 | A1 * | 10/2021 | Bull | E21B 43/2607 |

OTHER PUBLICATIONS

Cameron (A Schlumberger Company) Brochure entitled: MonoFlex—Dual-connection fracturing fluid delivery technology (1 page).

GE Oil & Gas brochure entitled: Shale 360TM Services—Vertical Frac Manifold (2 Pages).

KLX Energy Services Brochure: Frac PL Sales (29 Pages).

Weir Oil & Gas Brochure: SeaboardTM One Straight Line Frac Connection (2 pages).

SPM Oil and Gas (A Caterpillar Company) Brochure entitled: Simplified Frac Iron System (12 Pages).

* cited by examiner

FRAC DISTRIBUTION TOWER

CROSS-REFERENCE TO RELATED APPLICATIONS

Not applicable.

FIELD OF INVENTION

The subject matter disclosed herein relates to systems for distributing pressurized hydraulic fracturing fluid from a high pressure supply source to multiple wellheads in a well pad.

BACKGROUND

During the development of oil and gas wells, it is common practice to enhance or stimulate the recovery of oil or gas by fracturing the production zones accessed by the well(s). This hydraulic fracturing has been used to stimulate production in oil and gas wells since the 1950*s*. The hydraulic fracturing process is accomplished by introducing liquids, such as water, under very high pressure into the producing zones of the well(s). These liquids often also include materials such as sand or bauxite or other materials referred to as propates, whose purpose it is to "prop" open fractures created in the producing formations by the high pressure fluids.

In typical fracing operations, a supply of high pressure fluid is provided by several triplex or quintuplex pumps that are situated on flatbed trailers and positioned near the wellsite. A long manifold with multiple input and output valves (often referred to as a zipper manifold or "missile") may be positioned between the pumps to direct frac fluids from holding tanks to the pumps, and to combine the pressurized fluid outputs from the several pumps into one or more supply lines leading toward the well pad.

A well pad may include several wellheads, often four to six or more wellheads. At the well pad, each high pressure frac supply line coming from the pumps may supply a single wellhead, or the supply line(s) may be divided so that each wellhead is supplied by one high pressure supply line. A "frac manifold" may be employed to control the supply of frac fluid to each wellhead, whereby the frac manifold receives the pressurized frac fluids and includes a valve to open or close the supply of pressurized frac fluid to the corresponding wellhead. Thus, a four-wellhead system may require four "frac manifolds" and require a corresponding increase in the complexity of the various fittings, valves, and pressure lines. This problem may be compounded when the well pad is a distance from the pumps and zipper manifold.

A frac manifold may also be provided with a special fitting called a "goathead" that divides the flow of frac fluid into several streams that are all connected from the frac manifold to the corresponding single target wellhead. At the wellhead, the divided streams are then reassembled into a single stream by means of a reverse "goathead" positioned on the frac tree. These multiple supply lines of high pressure frac fluid often create a complex maze of metal pipes and fittings that are necessary to reach the inlet of the frac tree of each wellhead. This typically also requires numerous different connections that are each subject to potential leaks, and thus, it often involves more equipment costs and takes more time to install and rig down.

As such, there is a longstanding need to reduce the complexity of these multiple supply lines, reduce the amount and variety of equipment necessary to connect high pressure supply lines to each wellhead, and to reduce the number of potentially hazardous connections necessary between each high pressure pipe segment.

SUMMARY

Frac distribution towers as disclosed herein reduce the complexity of the multiple high pressure supply lines typically used in hydraulic fracturing systems. They also reduce the number of different pieces of equipment necessary to connect the supply lines, and reduce the number of potentially leaky connections necessary between each high pressure pipe segment.

This reduction in complexity of the necessary frac equipment tends to reduce the time required to connect and remove frac equipment, provides for significant cost savings, as well as reduces the likelihood of injury to personnel occurring while working in and around the complex piping systems at a wellsite. As discussed in more detail below, the use of frac distribution towers may also allow for the simultaneous stimulation of two or more wells.

Examples of the frac distribution towers as described herein may be positioned on a base and have a centerline and an inlet to receive high pressure frac fluid. The frac distribution tower may include a plurality of outlets arranged generally perpendicular to an axis formed by the centerline of the frac distribution tower. The outlets may each include a valve for connecting the fluid flow path to a corresponding frac tree on the well head, and to selectively open one or more fluid flow paths to each corresponding frac tree. In one aspect, the inlet of the frac distribution tower has a centerline and the outlets are all located on the same side of a plane defined by the centerline of the frac distribution tower and the centerline of the inlet.

In other aspects, the valves may be oriented horizontally, vertically, or angularly between horizontal and vertical. In further aspects, the inlet and the outlets may have the same size and pressure rating, or the outlets may have a smaller size than the inlet, such that multiple wells may be fracked simultaneously.

Fluid flow from a high pressure source to the tower may be controlled by an inlet valve oriented horizontally and mounted upstream from both the outlets and a lower ell fitting on the tower. In addition, a tee fitting may be positioned upstream from the inlet valve, such that the frac distribution tower may be isolated from the high pressure frac fluid. Components of the frac distribution tower may be connected with a spool piece, such that the components may be rotated with respect to each other.

In additional aspects, more than one frac distribution tower may be positioned on a well pad and connected to each other using a tee fitting so as to provide high pressure frac fluid to the frac trees on additional wells.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION OF SPECIFIC EMBODIMENTS

One or more specific embodiments of the current disclosure will be described below. It will be appreciated that not all possible variations will be described. However, additional variations will become apparent to persons skilled in the relevant art as a result of the detailed description of the following several embodiments.

Figure 1:
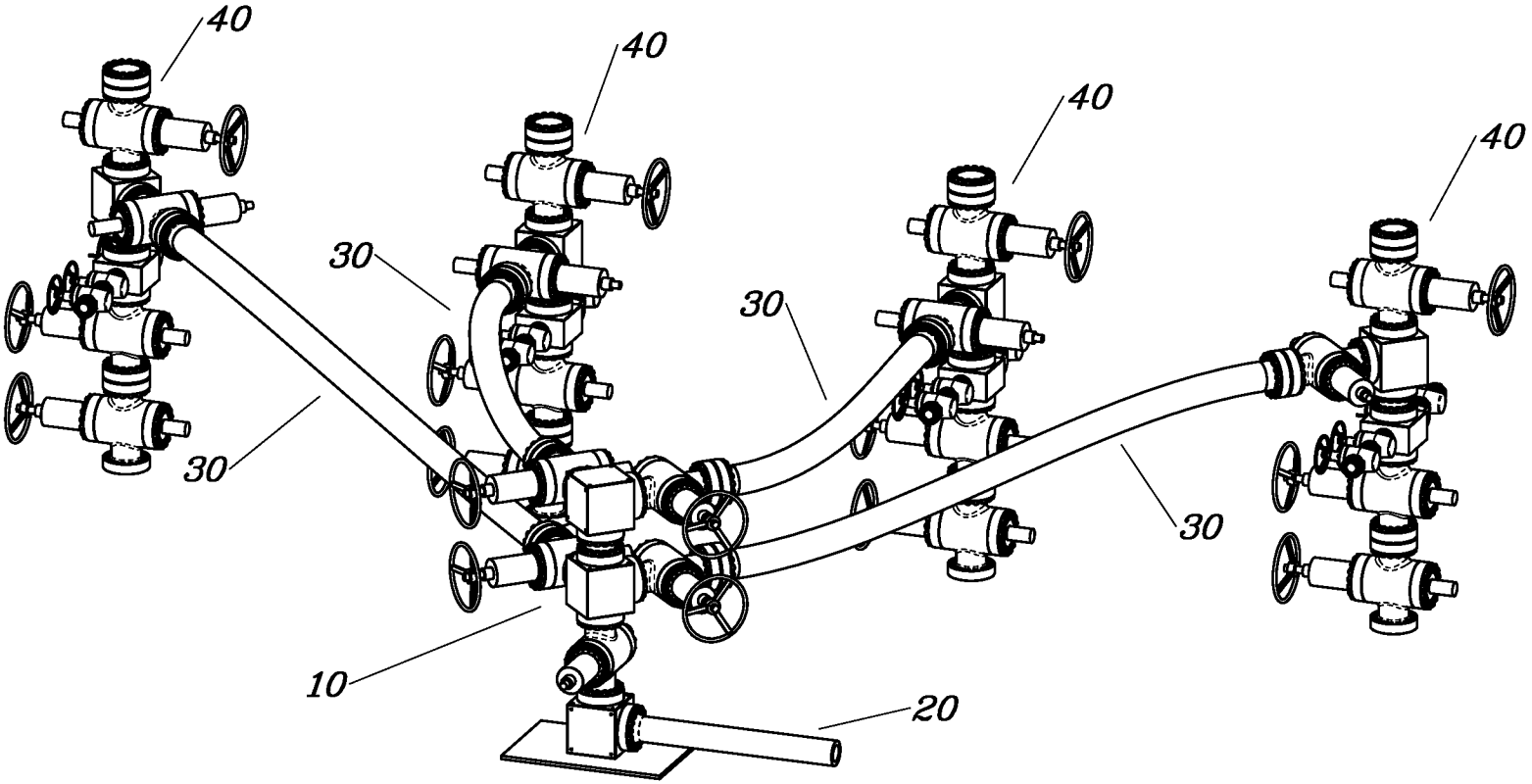
FIG. 1 is a perspective view illustrating a system with a single frac distribution tower distributing pressure for fracturing four wells on a well pad at the same time.
Figure 1A:
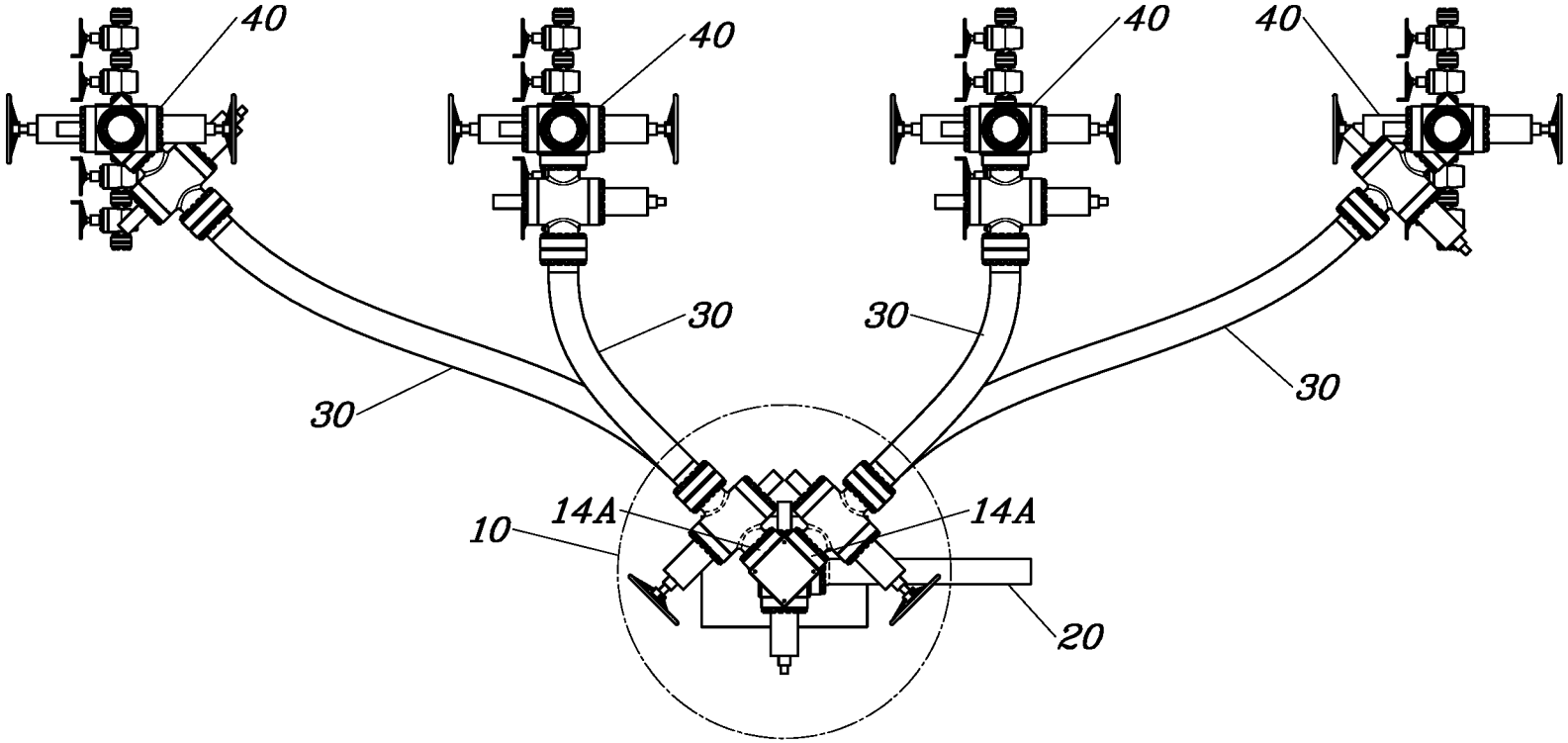
FIG. 1A is an overhead plan view of the system illustrated in FIG. 1.

FIGS. 1 and 1A depict a system including a frac distribution tower 10 providing for the distribution of frac fluid from a high pressure source (not shown) through a single supply line 20 to multiple frac trees 40 positioned on top of subterranean oil or gas wells (not shown). High pressure frac fluid is provided to each of the frac trees 40 by high pressure flexible hoses 30. Alternatively, metal pipes and fittings (not shown) may be used to connect each well to the frac distribution tower 10. Thus, a single frac distribution tower 10 can deliver high pressure frac fluids to multiple frac trees on multiple wells.

Figure 1B:
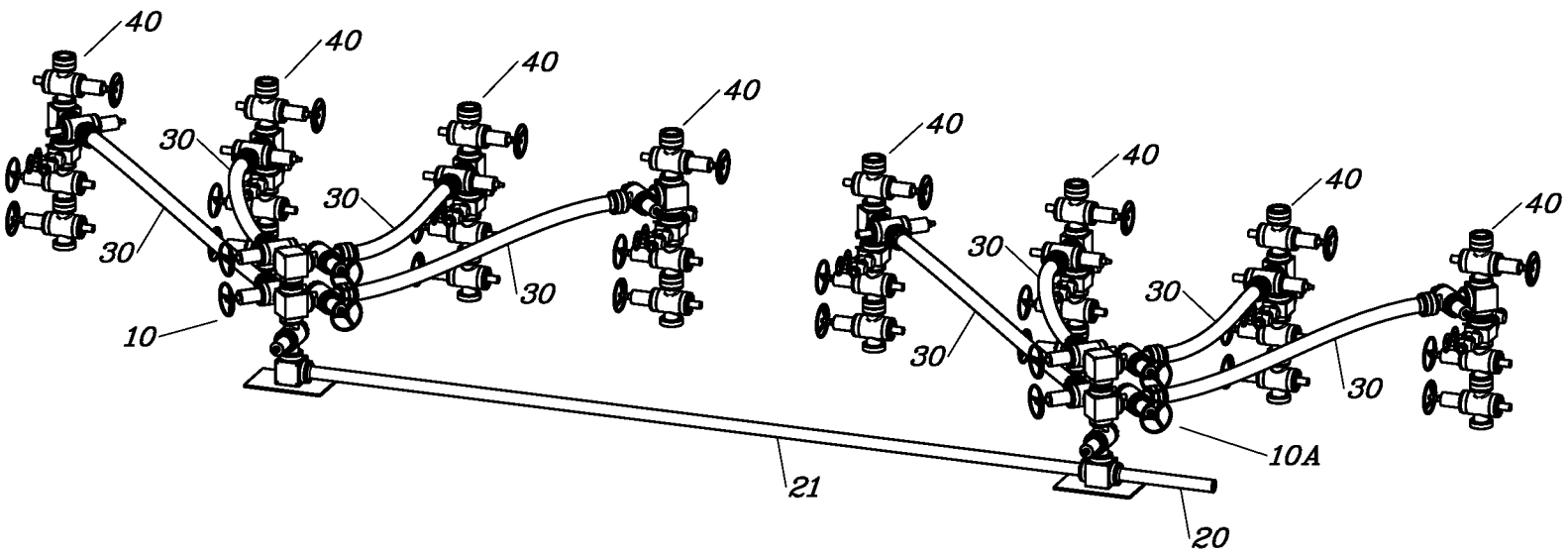
FIG. 1B is a perspective view illustrating a system with two frac distribution towers distributing pressure for fracturing eight wells at the same time.

FIG. 1B depicts a system including an additional frac distribution tower 10 positioned downstream from an upstream frac distribution tower 10A. A supply line 20 supplies high pressure frac fluid to the upstream frac distribution tower 10A. A downstream supply line 21 provides high pressure frac fluid from upstream frac distribution tower 10A to the downstream frac distribution tower 10. In this manner, a single supply line 20 may be used to supply high pressure frac fluids to eight different wells using only two frac distribution towers 10, 10A.

Figure 1C:
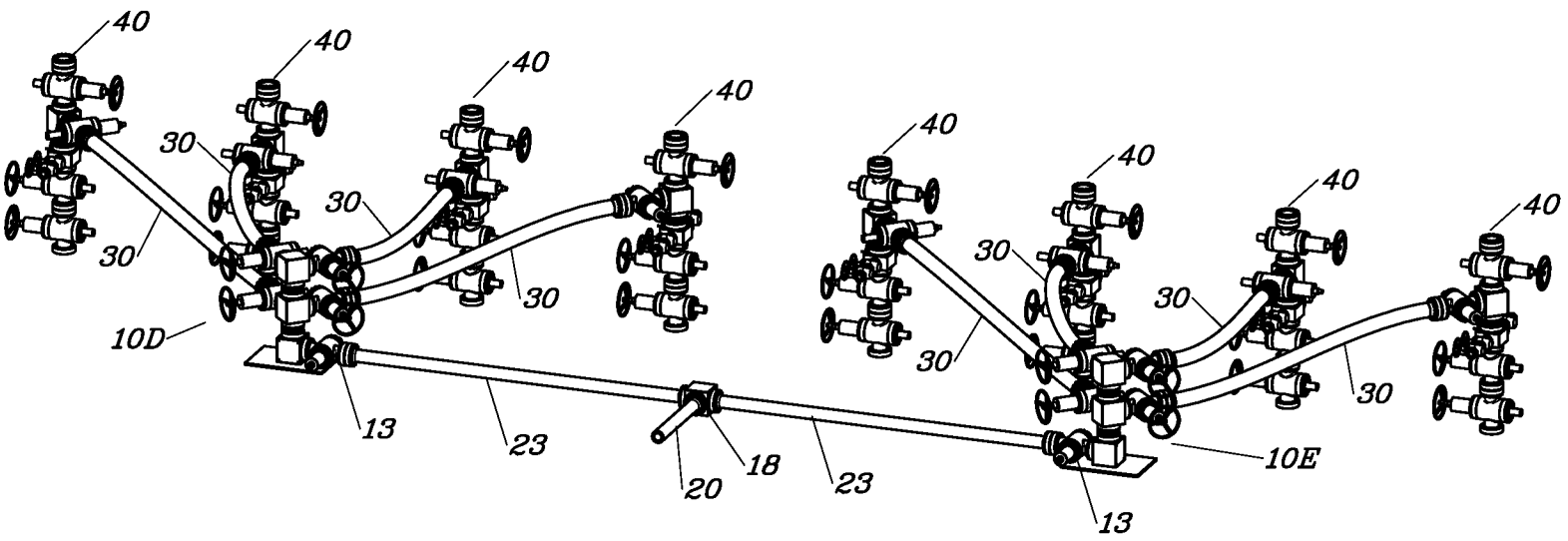
FIG. 1C is a perspective view illustrating an alternative system with two frac distribution towers servicing eight wells.

FIG. 1C depicts an alternate configuration where frac distribution towers 10D and 10E each supply high pressure frac fluid to four frac trees 40. High pressure frac fluid is supplied by a centrally located line 20, and split into two lines 23 using a tee 18. Each line 23 supplies high pressure frac fluid to the respective frac distribution tower 10D and 10E. Each frac distribution tower 10D and 10E includes a control valve 13 at an upstream inlet of said towers. In this manner, the supply of high pressure frac fluid may be selectively shut off or supplied to either one or both of frac distribution towers 10D and 10E.

Frac distribution towers 10 may be assembled and tested in a shop prior to delivery to a frac site. In this manner, significant time would be saved when such a frac distribution tower 10 is installed at the frac site to supply high pressure frac fluids to multiple wells. Additionally, multiple connections ordinarily required when using several frac manifolds will be eliminated. Each of those eliminated connections is a potential source of leaks.

Figure 2:
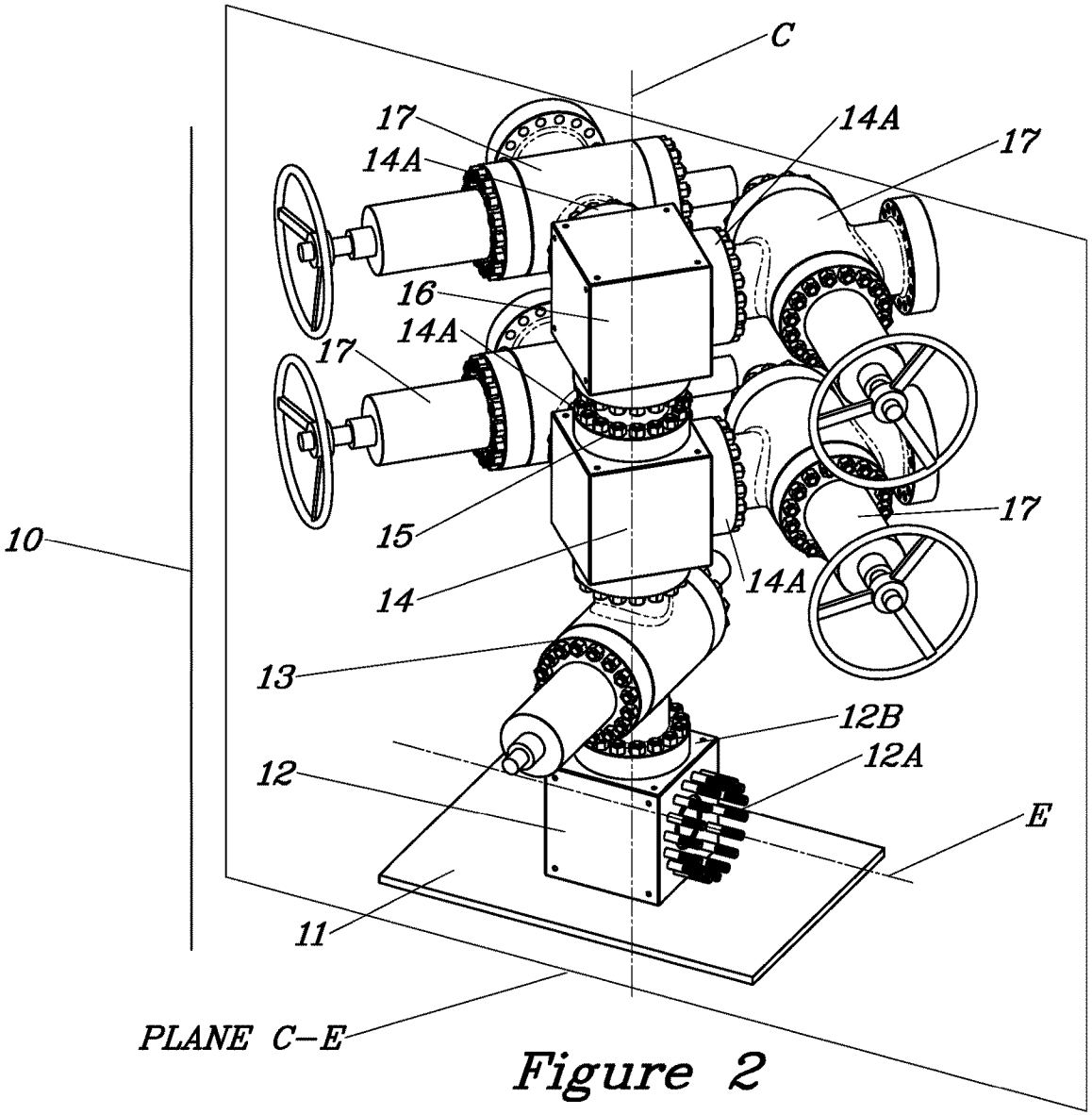
FIG. 2 is a perspective view of a frac distribution tower having four outlets of the same size as the inlet.

FIG. 2 depicts an embodiment of a frac distribution tower 10, such as the downstream frac distribution tower 10 in FIG. 1 and frac distribution tower 10D in FIG. 1C. Frac distribution tower may include a supporting skid or base 11 to support the tower 10 having a centerline C in an upright position on the ground surface at the frac site. Positioned above the base 11 is an ell fitting 12 having an inlet 12A with a centerline E and an outlet 12B, both of which may have the same size and pressure rating. Positioned above the ell fitting 12 is valve 13, which is preferably an automatically controlled high pressure gate or plug valve. Valve 13 may be used to control the supply of high pressure frac fluids to the frac distribution tower 10. Tee 14 is positioned above the valve 13. Tee 14 is a modified standard tee with two branched outlets 14A, wherein all connections have the same size and pressure rating. The outlets 14A of the tee 14 branch off generally perpendicular to the flow of frac fluid through the body of the tower 10 along centerline C that generally forms an axis of the frac distribution tower 10. The outlets 14A are each connected to a valve 17. Valve 17 may be connected to a frac tree 40 using flexible hose 30, as shown in FIGS. 1 and 1A. As best shown in FIGS. 1A and 2, the stacked arrangement of outlets 14A and valves 17 permits all outlets 14A to be on the same side of plane C-E defined by centerlines C and E and thus potentially save space on the well pad.

Referring again to FIG. 2, spool piece 15 connects the tee 14 to an ell fitting 16 having all of its connections of the same size and pressure rating. Alternatively, tee 14 and ell fitting 16 may have integral flanges (not shown) so that tee 14 and ell fitting 16 may be connected together without using a separate spool piece 15. The two outlets from tee 14 and ell fitting 16 branch off generally perpendicular to centerline C. In addition, the two outlets of tee 14 and the two outlets of ell fitting 16 each have a valve 17 to selectively control the supply of high pressure frac fluid to each individual frac tree. Valve 17 may be a handwheel operated valve 17 as shown in FIG. 2 or an automatically controlled high pressure gate or plug valve (not shown). In brief overview, high pressure frac fluid enters the frac distribution tower 10 at inlet 12A, flows through ell fitting 12, through valve 13, through tee 14, and is alternatively supplied to one of four frac trees selected by opening the corresponding one of four valves 17. Alternatively, the frac distribution tower 10 may be entirely isolated from high pressure frac fluid by closing valve 13, which may be remotely controlled.

Figure 2A:
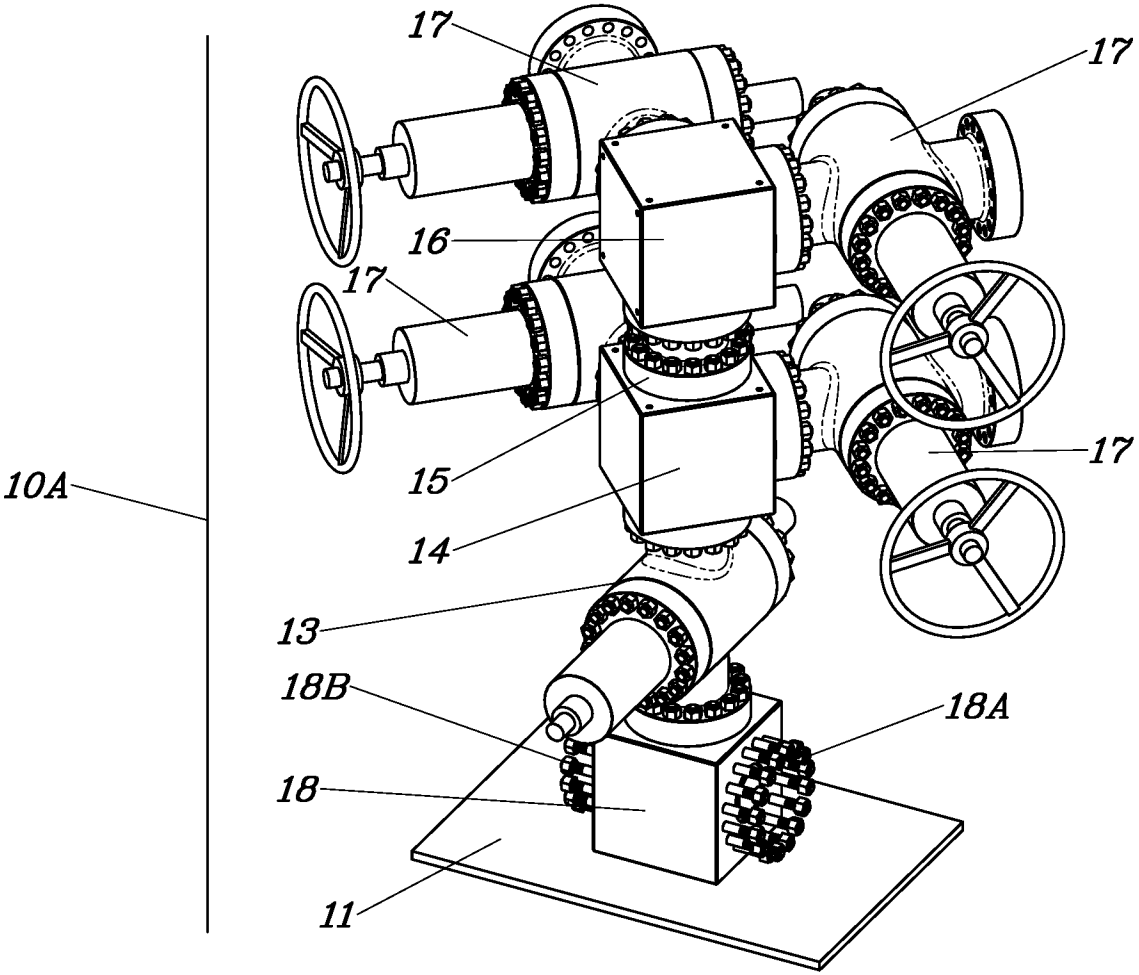
FIG. 2A is a perspective view of an alternative frac distribution tower having an inlet tee to allow connections to other frac distribution towers or other pressure sources.

FIG. 2A depicts a second embodiment of a frac distribution tower 10A, such as upstream frac distribution tower 10A shown in FIG. 1B. Frac distribution tower 10A generally includes the same components as frac distribution tower 10 depicted in FIG. 2. However, mounted on base 11 is a tee fitting 18 instead of ell fitting 12 as depicted in FIG. 2. This lower tee fitting 18 has an inlet 18A and an outlet 18B. As depicted in FIGS. 1B and 2A, high pressure frac fluid from a high pressure source, such as the output of a zipper manifold, is supplied to the system by supply line 20, which is connected to the inlet 18A of tee fitting 18. High pressure frac fluid then exits tee fitting 18 at outlet 18B, where it follows the downstream supply line 21 to supply downstream frac distribution tower 10. Frac distribution tower 10A may be isolated by closing valve 13. As with tower 10 depicted in FIG. 2, tower 10A depicted in FIG. 2B may use components with the same flow diameter and pressure rating so that pressurized frac fluid may be supplied to one of the frac trees 40 on the well pad. The frac tree 40 to be supplied high pressure frac fluid may be selected by opening one of valves 17 and closing the remaining valves 17. Alternatively, high pressure frac fluid may be selectively isolated from all of the four frac trees 40 connected to tower 10 or tower 10A by closing the respective valve 13 on tower 10 or tower 10A.

Figure 2B:
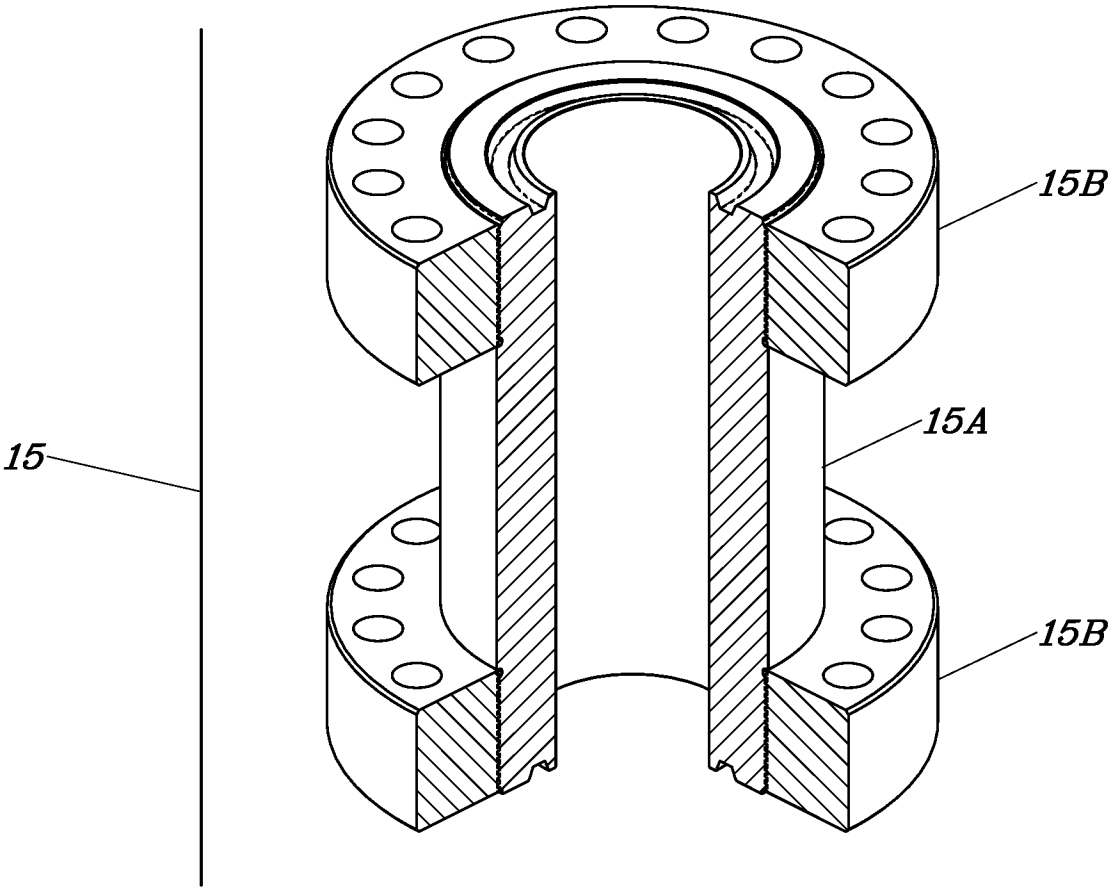
FIG. 2B is a perspective view of an embodiment of a frac spool that may be used to connect components in a frac distribution tower.

FIG. 2B depicts and example of a spool piece 15 that may be used to connect fittings in the frac distribution tower. Spool piece 15 has a body 15A that extends between two flanges 15B. The flanges 15B are rotatably connected to body 15A to provide a pressure-tight connection between two components and compensate for an angular deviation between the components, as may often be the case with pressurized components on a well pad.

Figure 3:
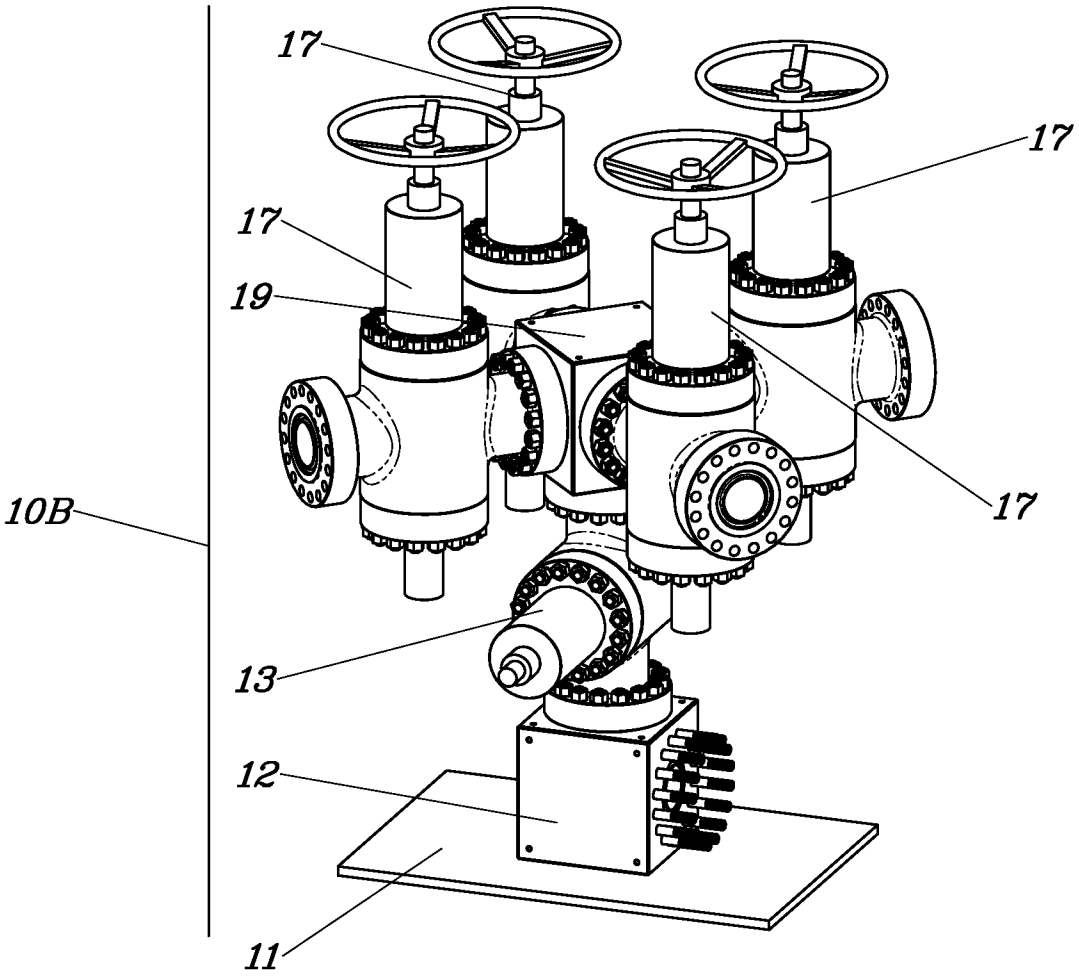
FIG. 3 is a perspective view of an alternative frac distribution tower having four outlets of the same size as the inlet, but arranged to service four wells in a 2×2 cluster instead of a single line of four wells.

FIG. 3 depicts an alternative embodiment of a frac distribution tower 10B wherein the four valves 17 are oriented vertically and all are all connected to the same cross fitting 19. Cross fitting 19 is mounted above control valve 13, which is mounted above ell fitting 12 and supported on base 11. Each of the four outlets of cross fitting 19 may be oriented generally perpendicular to the flow of high pressure frac fluid passing through valve 13. Additionally, each of the outlets on cross fitting 19 may be oriented 90 degrees from the adjacent outlet and the four valves 17 may be spaced apart equally around the centerline C (see FIG. 2). In this manner, the valves 17 may be oriented vertically, as opposed to horizontally as depicted in FIGS. 2 and 2A. As before, each of the fittings and valve may have the same flow diameter and pressure rating, so that high pressure frac fluids may be supplied to a select one of the frac trees 40 connected thereto. The configuration of FIG. 3 eliminates the upper ell fitting 16 depicted in FIGS. 2 and 2A. This configuration may provide a lower total height and may provide easier access to valves 17 on certain well pads that may have other equipment adjacent to the frac distribution towers 10B.

Figure 3A:
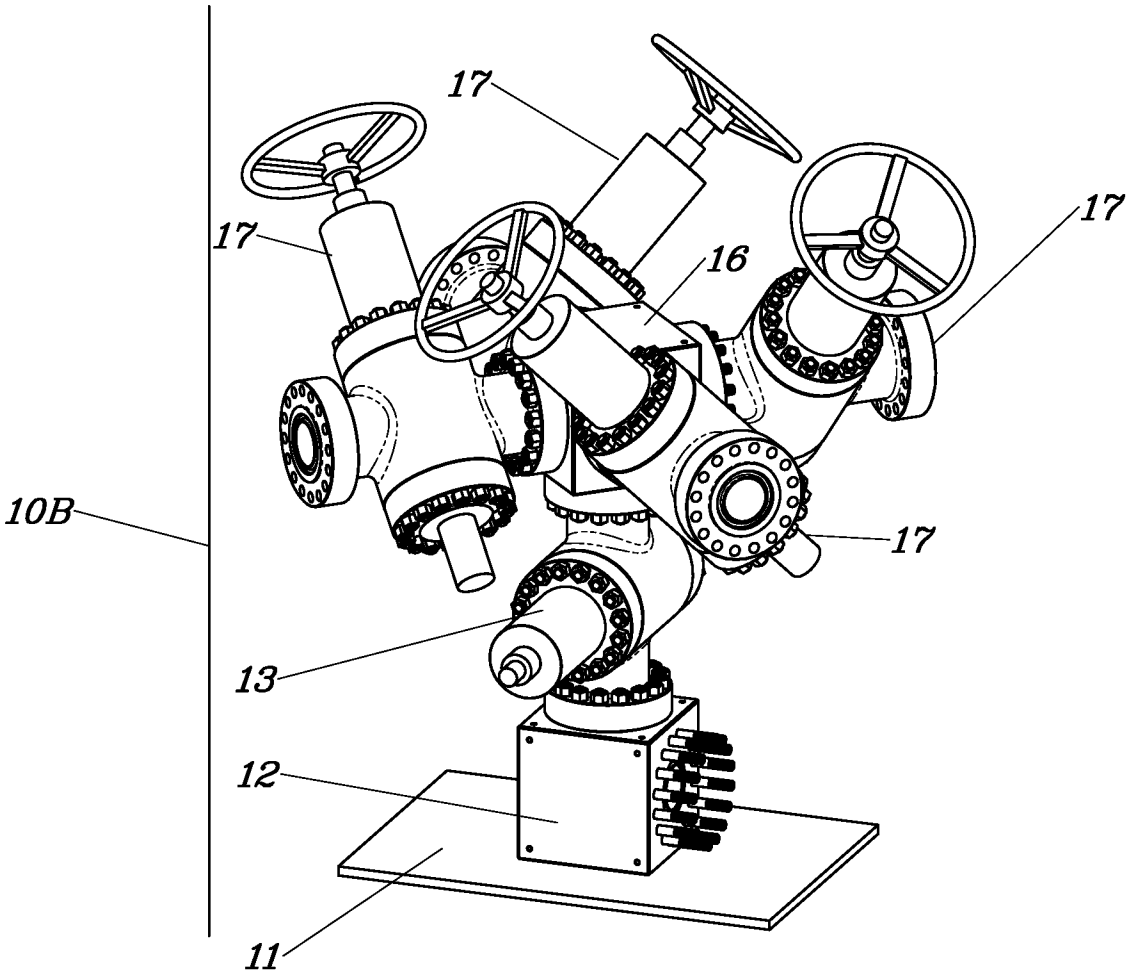
FIG. 3A is a perspective view of an alternative frac distribution tower having four outlet valves oriented angularly between vertical and horizontal.

FIG. 3A depicts an alternative frac distribution tower similar to the two 10B in FIG. 3, but with the outlet valves 17 oriented angularly between vertical and horizontal. Orienting the valves angularly in this manner may lower the height of the valve handwheels and make the valves easier to operate without using a ladder or climbing on the tower, thus reducing the risk of injuries.

Figure 4:
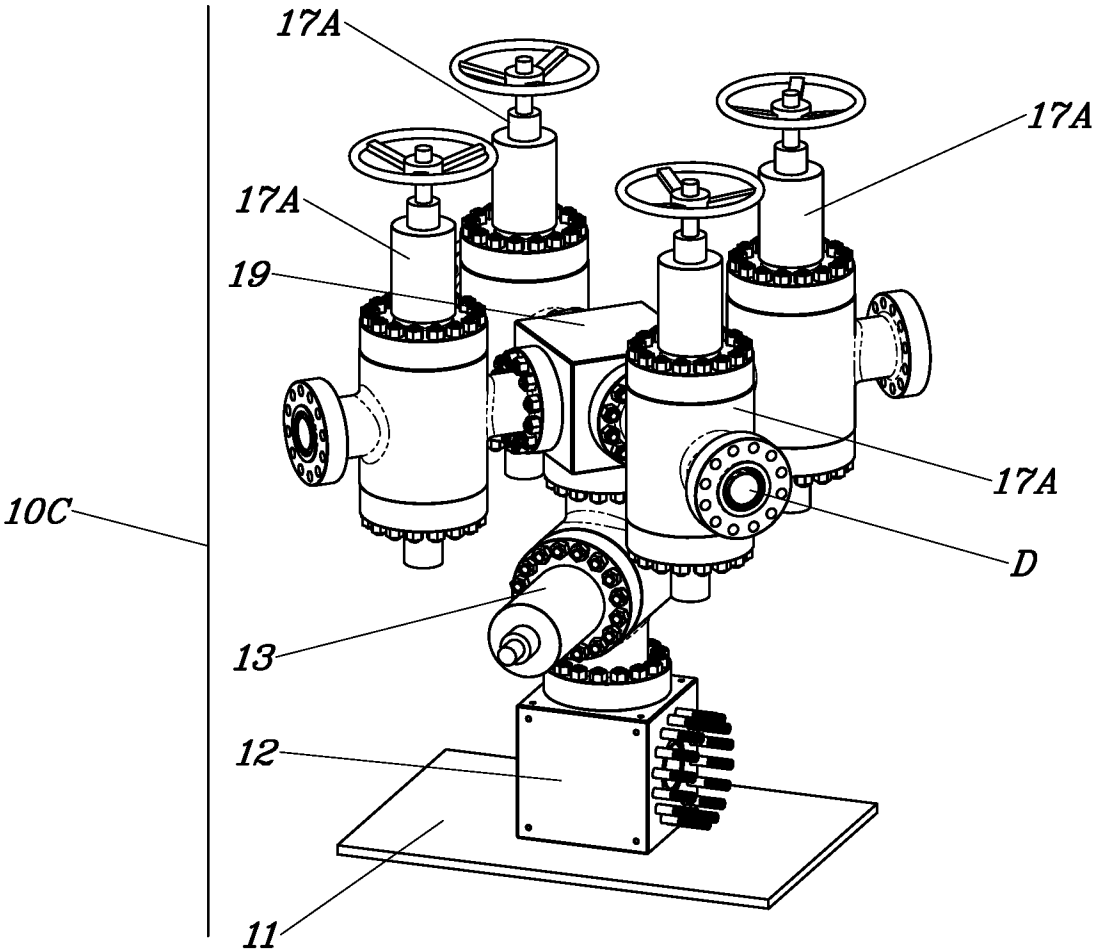
FIG. 4 is a perspective view of an alternative frac distribution tower similar to the tower depicted in FIG. 3, but having four outlets of a smaller size than the inlet so as to simultaneously frac more than one well at a time.

FIG. 4 depicts a fourth embodiment of a frac distribution tower 10C, which is similar to the embodiment depicted in FIG. 3. The tower 10C includes four vertically-oriented valves 17 which have the same pressure rating as the other components, but a smaller flow diameter D. This smaller flow diameter D permits fracturing more than one well at a time. By way of example, all four valves 17 may be opened at one time to simultaneously supply high pressure frac fluids to all four frac trees 40 on each of the four wells. This same configuration having a reduced flow diameter may be employed on the valves 17 of the other embodiments disclosed herein in order to simultaneously supply high pressure frac fluid to more than one of the frac trees 40.

Figure 5:
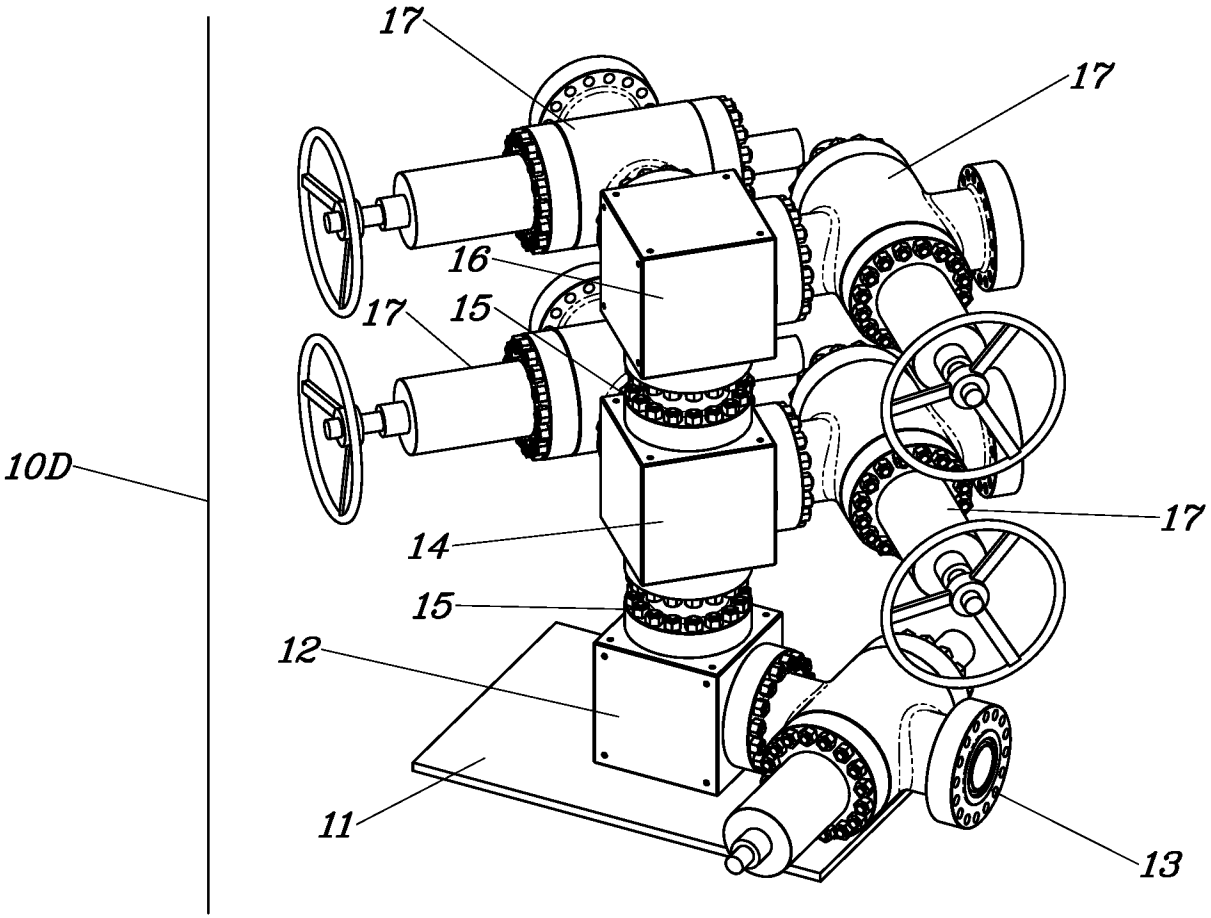
FIG. 5 is a perspective view of an alternative frac distribution tower similar to the frac distribution tower of FIG. 1, wherein an inlet control valve is mounted at the inlet to the ell as opposed to the top outlet of the ell.
Figure 5A:
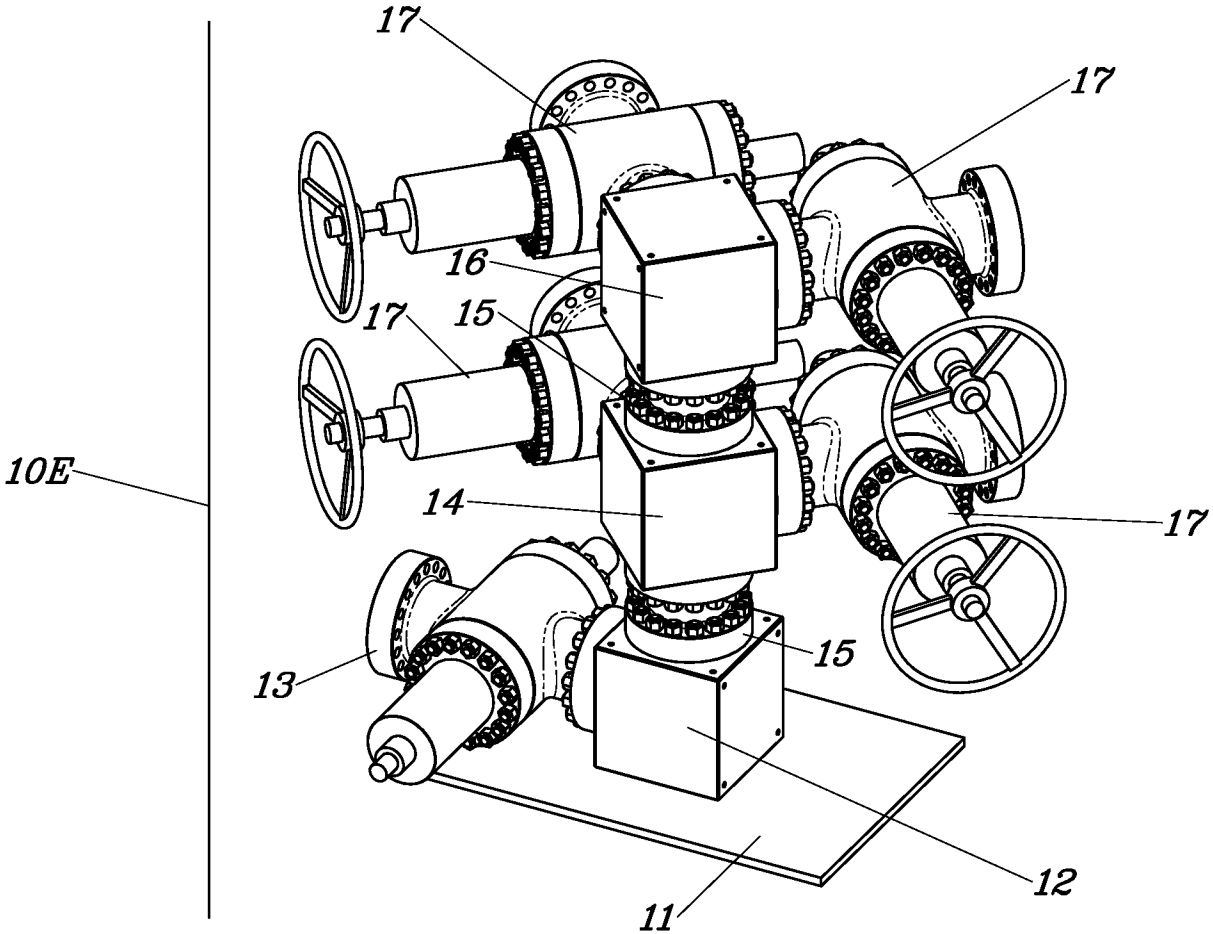
FIG. 5A is a perspective view of an alternative frac distribution tower similar to the frac distribution tower of FIG. 5, wherein the inlet control valve and inlet ell fitting are rotated 180 degrees to facilitate different arrangements.

FIG. 5 depicts an alternate embodiment of a frac distribution tower 10D that is similar to the frac distribution tower 10 depicted in FIG. 2. However, in this embodiment, control valve 13 is mounted upstream from the lower ell fitting 12. Thus, control valve 13 may receive high pressure frac fluid directly from the supply line 20. Additionally, by closing control valve 13, this configuration may permit removing the entire frac distribution tower, including lower ell fitting 12, from a well pad, either for servicing, reconfiguration, or replacement. This configuration may also reduce the overall height of the frac distribution tower 10D and make access to the hand wheels on valves 17 easier and potentially safer. A lower spool piece 15 connects the lower ell fitting 12 to the tee fitting 14. In this manner, the orientation of control valve 13 with respect to the rest of the tower 10D may be changed simply by rotating and reconnecting the lower spool piece 15, as depicted in FIG. 5A.

It will be recognized by those skilled in the art that the structure of the frac distribution towers 10-10D described herein may be machined molded from a single block or otherwise use a single-piece construction instead of the individual components (lower ell fitting 12, upper tee fitting 14, spool pieces 15, upper ell fitting 16, and lower tee fitting 17) as depicted in FIGS. 1-5A. Combining one or more of such components in a single block may be more difficult to manufacture, but would also reduce the number of pressure connections and potential leak points.

While embodiments of the disclosure have been shown and described, modifications thereof can be made without departing from the spirit and teachings of the invention. The embodiments and examples described herein are exemplary only, and are not intended to be limiting. Many variations and modifications of the frac distribution towers herein described are possible and are within the scope of the invention. Alternative embodiments that result from combining, integrating, duplicating, and/or omitting features of the embodiment(s) are also within the scope of the disclosure.

Accordingly, the scope of protection is not limited by the description set out above but is only limited by the claims which follow, the scope of which includes all equivalents of the subject matter of the claims. Each and every claim is incorporated into the specification as an embodiment. Thus, the claims also provide a further description and are an addition to the detailed description of the present invention. The disclosures of all patents, patent applications, and publications cited herein are hereby incorporated by reference.

What is claimed is:

1. An apparatus comprising:

a frac distribution tower with a single vertically oriented centerline and a single inlet to receive high pressure frac fluid from a single high pressure source;

a base to support the frac distribution tower;

a fluid flow path from the inlet, through the centerline of the frac distribution tower, and to a plurality of outlets arranged generally perpendicular to an axis formed by the centerline of the frac distribution tower; and wherein the plurality of outlets each includes a valve for connecting the fluid flow path to a corresponding frac tree on a well head, and to selectively open one or more fluid flow paths to each corresponding frac tree.

2. The apparatus of claim 1 wherein the inlet has a centerline, and the outlets are all located on the same side of a plane defined by the centerline of the frac distribution tower and the centerline of the inlet.

3. The apparatus of claim 2 wherein the valves are all oriented horizontally.

4. The apparatus of claim 2 wherein the valves are all oriented vertically.

5. The apparatus of claim 2 wherein the valves are all oriented angularly between vertical and horizontal.

6. The apparatus of claim 1 wherein the inlet and the outlets are of the same size and pressure rating.

7. The apparatus of claim 1 wherein the tower outlets are all of a smaller size than the tower inlet, such that more than one well may be fracked simultaneously.

8. The apparatus of claim 1 further including an inlet valve to control fluid flow from the pressure source to the frac distribution tower, wherein the inlet valve is mounted upstream from the outlets.

9. The apparatus of claim 8 wherein the inlet valve is mounted horizontally.

10. The apparatus of claim 9 wherein the inlet valve is mounted on the lower ell fitting and the lower ell fitting is mounted on the frac distribution tower by spool piece, such that the orientation of the inlet valve may be changed by changing the rotation of the spool piece.

11. The apparatus of claim 8 wherein the inlet valve is mounted upstream from a lower ell fitting on the frac distribution tower.

12. The apparatus of claim 8 further including a tee fitting upstream from the inlet valve, such that high pressure frac fluid flows into and out of the frac distribution tower upstream of the inlet valve and the frac distribution tower may be isolated from the high pressure frac fluid.

13. The apparatus of claim 1, wherein the outlets are spaced apart equally around the centerline of the frac distribution tower, and wherein one well may be fracked at a time or more than one well may be fracked simultaneously.

14. A system comprising:

a first frac distribution tower and a second frac distribution tower;

wherein each frac distribution tower further includes:

a single inlet to receive high pressure frac fluid from a single high pressure source:

a single vertically oriented fluid flow path through the frac distribution tower from the inlet to a plurality of outlets;

a valve on each of the plurality of outlets for connecting the fluid flow path to a corresponding plurality of frac trees, and to selectively open the fluid flow path to each corresponding frac tree;

an inlet valve to control fluid flow from the pressure source to the frac distribution tower, and through the vertically oriented fluid flow path, wherein the inlet valve is mounted upstream from the outlets;

wherein the first and second frac distribution towers are in fluid communication with each other.

15. The system of claim 14 wherein the first frac distribution tower includes a tee fitting upstream from the inlet valve, and the tee fitting is configured to flow high pressure frac fluid to the second frac distribution tower through a downstream supply line.

16. The system of claim 14 further including a tee fitting positioned between the first and second frac distribution towers, wherein the tee fitting includes an inlet to receive high pressure frac fluid from the single source, and the tee fitting includes two outlets to supply high pressure frac fluid to each of the first and second frac distribution towers.

17. The system of claim 14 wherein each frac distribution tower has a centerline and the inlet of each frac distribution tower has a centerline, and the outlets on each frac distribution tower are all located on the same side of a plane defined by the centerline of the frac distribution tower and the centerline of the inlet.

18. The system of claim 17 wherein the valves of each frac distribution tower are all oriented angularly between vertical and horizontal.

19. The system of claim 14 wherein the valves on the first and second frac distribution towers are all oriented horizontally.

20. The system of claim 14 wherein the inlet and the outlets of each frac distribution tower are of the same size and pressure rating.

21. The system of claim 14 wherein the outlets of at least one frac distribution tower are all of a smaller size than the tower inlets, such that more than one well may be fracked simultaneously from the at least one frac distribution tower.

22. The system of claim 14 wherein the inlet valve on each of the frac distribution towers is mounted horizontally.

* * * * *